US007350885B2

(12) United States Patent
Bodingbauer

(10) Patent No.: US 7,350,885 B2
(45) Date of Patent: Apr. 1, 2008

(54) DRAWER

(75) Inventor: Markus Bodingbauer, Höchst (AT)

(73) Assignee: Julius Blum Gesellschaft m.b.H., Industriestrasse (AT)

( * ) Notice: Subject to any disclaimer, the term of this patent is extended or adjusted under 35 U.S.C. 154(b) by 734 days.

(21) Appl. No.: 10/397,343

(22) Filed: Mar. 27, 2003

(65) Prior Publication Data

US 2003/0184198 A1 Oct. 2, 2003

(30) Foreign Application Priority Data

Mar. 29, 2002 (AT) ..... 197/2002 U

(51) Int. Cl.
*A47B 88/00* (2006.01)

(52) U.S. Cl. ..... 312/348.3; 312/330.1; 220/551

(58) Field of Classification Search ..... 312/330.1, 312/348.1, 348.2, 348.3; 220/500, 529, 530, 220/536, 552, 533, 535, 551
See application file for complete search history.

(56) References Cited

U.S. PATENT DOCUMENTS

| | | | | | |
|---|---|---|---|---|---|
| 923,165 | A * | 6/1909 | Goldman | 312/31 |
| 1,052,516 | A * | 2/1913 | Ringer | 108/109 |
| 2,148,681 | A * | 2/1939 | Cameron | 220/551 |
| 2,214,042 | A * | 9/1940 | Burdick | 220/553 |
| 2,718,326 | A * | 9/1955 | Le Blanc | 220/533 |
| 4,475,657 | A * | 10/1984 | Albery | |
| 4,726,635 | A * | 2/1988 | Rariden et al. | |
| 4,957,213 | A * | 9/1990 | White et al. | 220/559 |
| 6,493,917 | B1 * | 12/2002 | Sunka | 29/413 |
| D473,080 | S * | 4/2003 | Kellogg | D6/491 |
| 6,834,924 | B2 * | 12/2004 | Hollenstein | 312/348.3 |

FOREIGN PATENT DOCUMENTS

| | | | | |
|---|---|---|---|---|
| AT | 003039 | * | 9/1999 | |
| AT | 004052 | * | 1/2001 | |
| CH | 239918 | * | 3/1946 | 312/348.3 |
| CH | 476477 | * | 8/1969 | |
| DE | 746652 | * | 8/1944 | |
| DE | 3901331 | * | 7/1990 | 312/348.3 |
| DE | GM 397/2001 | * | 5/2001 | |
| DE | GM 849/2001 | * | 11/2001 | |
| EP | 257829 | * | 3/1988 | 312/348.3 |
| GB | 1160414 | * | 8/1969 | 312/348.3 |
| WO | 01/84980 | * | 11/2001 | |
| WO | WO 01/84980 | * | 11/2001 | |

* cited by examiner

*Primary Examiner*—James O. Hansen
(74) *Attorney, Agent, or Firm*—Wenderoth, Lind & Ponack, L.L.P.

(57) ABSTRACT

A drawer has a drawer side wall on each side, a rear wall, a front terminating wall, a drawer base plate and transverse dividers. A horizontal rail is arranged on the inside of each drawer side wall, extending from the drawer rear wall to the front terminating wall. The rails are provided with holes and/or depressions in which holding tabs or the like of the dividers may latch.

8 Claims, 4 Drawing Sheets

DRAWER

BACKGROUND OF THE INVENTION

1. Field of the Invention

The invention relates to a drawer having a drawer side wall on each side, a rear wall, a front terminating wall such as a front wall or front panel, a drawer base plate and transverse dividers that extend from one drawer side wall to the other, with a horizontal rail being arranged on the inside of each drawer side wall, extending from the drawer rear wall to the front terminating wall and being provided with holes and/or depressions in which holding tabs or the like of the dividers may latch.

2. Description of Related Art

Drawers having dividers are known. The dividers may be formed by partition walls or by rods. Advantageously, the drawer side walls or push-on walls for the drawer side walls are provided with holes or depressions in which the dividers latch by means of holding tabs. This makes it possible to position the dividers simply in the drawer while still ensuring the dividers are held securely.

The drawer side walls or push-on walls are, in accordance with the prior art, made from plastics material or metal, because these may readily be provided with the holes or depressions during manufacture.

SUMMARY OF THE INVENTION

The object of the invention is to provide a drawer in which the drawer side walls may be made from a wood material, for example, chipboard, and yet simple mounting of dividers is still possible.

The object of the invention is achieved in that the drawer side walls are constructed without holes or depressions and the rails abut laterally against the drawer side walls without being anchored thereto.

The invention may also be applied advantageously to drawers having side walls made of plastics material or metal. The drawer is made with closed drawer side walls without holes or depressions, which is preferable from the point of view of its appearance and as a result of which soiling of the drawer can be kept to a minimum. If no dividers are desired, the drawer can also be used without the rails according to the invention. If, however, dividers, either in the form of rods or in the form of flat partition walls, are to be inserted into the drawer, then the rails according to the invention may readily be made to abut against the insides of the drawer side walls and anchored there. It is then possible to secure the dividers as in the case of drawer side walls with holes.

Advantageously, it is provided for the rails to have at least at one end a spring press-on part by means of which they are supported against the rear wall or the front terminating wall of the drawer.

A further example of embodiment of the invention provides for each rail to be supported against the drawer base plate by way of two supporting struts.

In order to improve the connection between the rail and the supporting struts, in a preferred example embodiment of the invention, it is provided for the supporting struts to have on the upper edge projections that are received in depressions or openings in the rails.

BRIEF DESCRIPTION OF THE DRAWINGS

Example embodiments of the invention will be described below with reference to the figures of the attached drawings, in which.

DETAILED DESCRIPTION OF THE INVENTION

Figure 1:
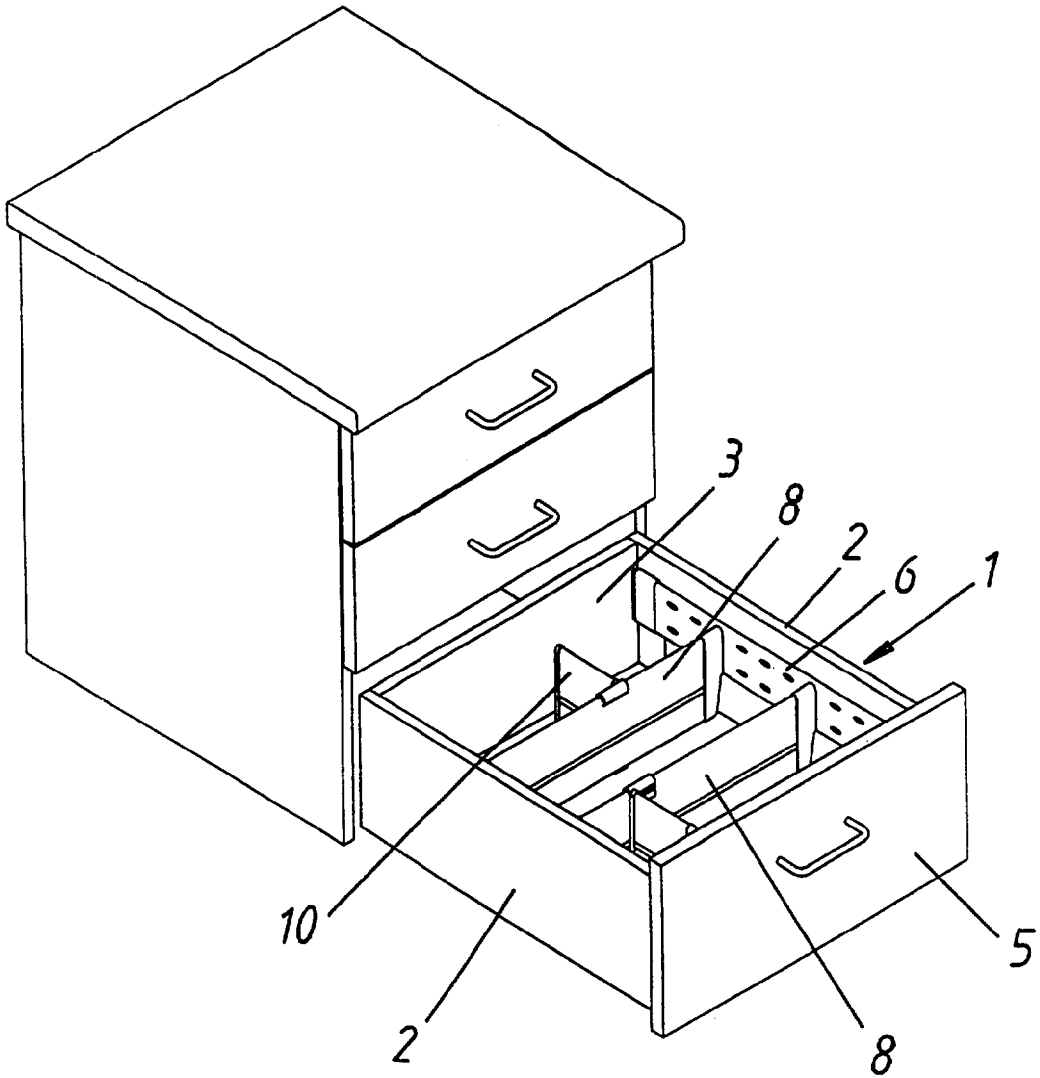
FIG. 1 is a diagrammatic view of an item of furniture having a drawer according to the invention, with partition walls being inserted into the drawer as dividers.
Figure 2:
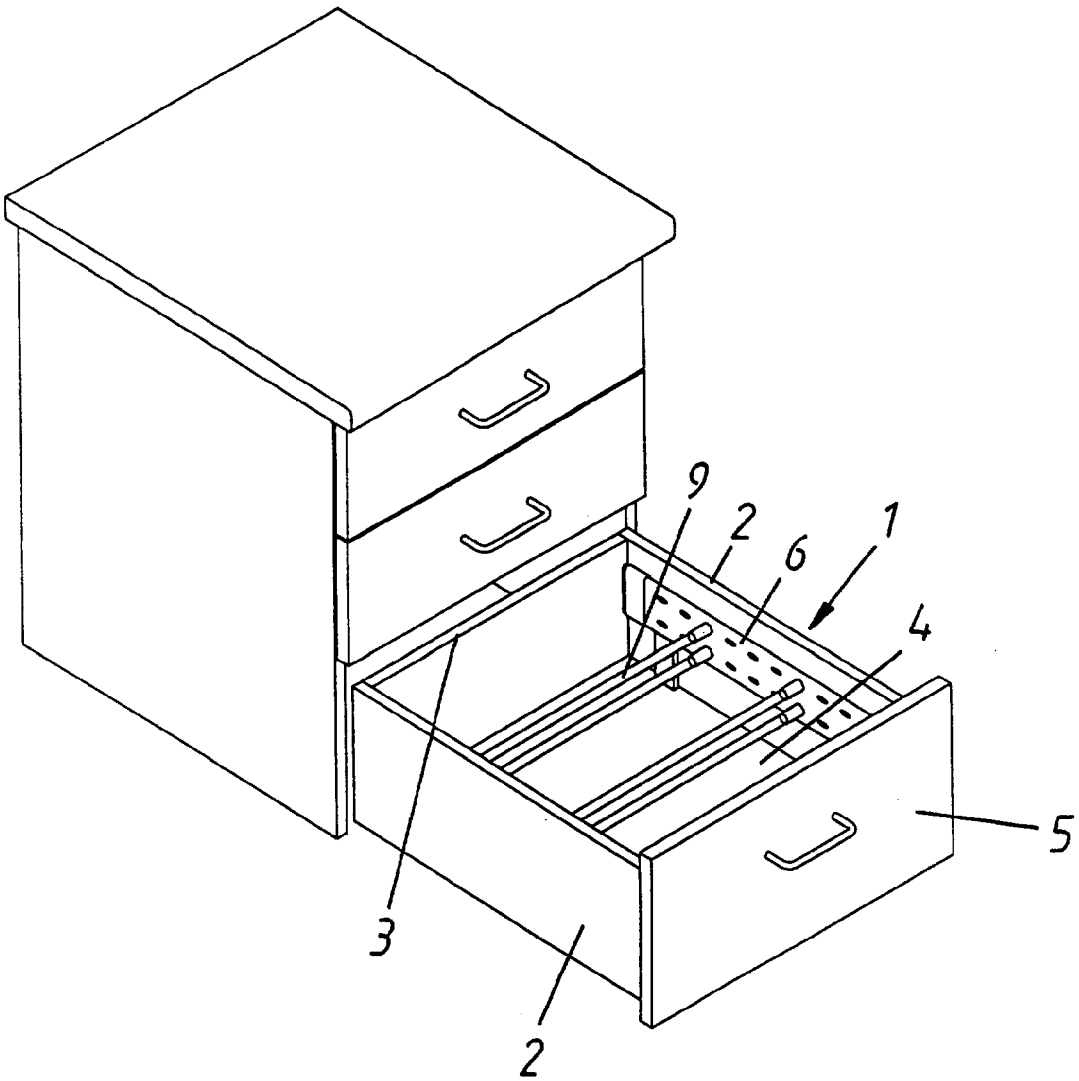
FIG. 2 is a diagrammatic view of an item of furniture having a drawer according to the invention, with dividers in the form of rods being inserted into the drawer.

The drawer 1 according to the invention comprises, in conventional manner, two drawer side walls 2, a rear wall 3, a drawer base plate 4, a front wall 11 and a front panel 5. It goes without saying that it would also be possible for only one front wall 11 or the front panel 5 to be provided.

The drawer side walls 2 are made from a wood material in the example embodiment shown.

Dividers in the form of partition walls 8 or partition rods 9 are inserted into the drawer 1.

Arranged on the inside of each drawer side wall 2 is a rail 6 according to the invention. The rail 6 is not secured to the drawer side wall 2, but is supported against the drawer rear wall 3 and the front wall 11 by being expanded.

The height h of the rail 6 is less than the height H of the drawer side wall 2 as measured in the interior of the drawer 1.

The rails 6 are constructed as a box-type profile with double walls, and the outer walls of the rails 6 are provided with openings or depressions 13.

At one end, the rails 6 have a spring-loaded press-on part 17 that in the example embodiment is shown pressed against the drawer rear wall 3 by springs 18. The rails 6 are thus braced between the front wall 11 and the drawer rear wall 3 by the expansion.

In order to increase stability of the rails 6, supporting struts 7 are provided against which the rails 6 are supported and which are themselves supported against the drawer base plate 4.

In the example embodiment shown, the supporting struts 7 each have a web-like projection 14 that is received in an opening in the lower edge of the rail 6.

Figure 3:
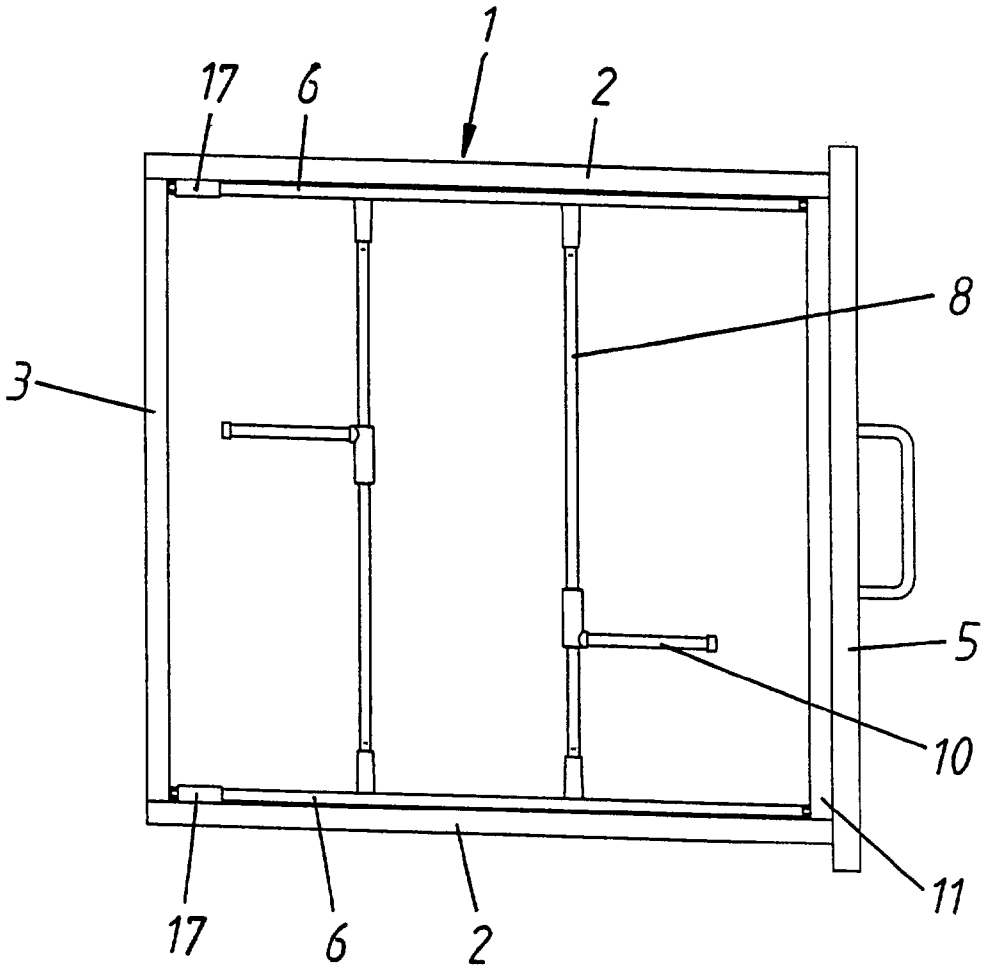
FIG. 3 is a plan view of a drawer.
Figures 4, 5:
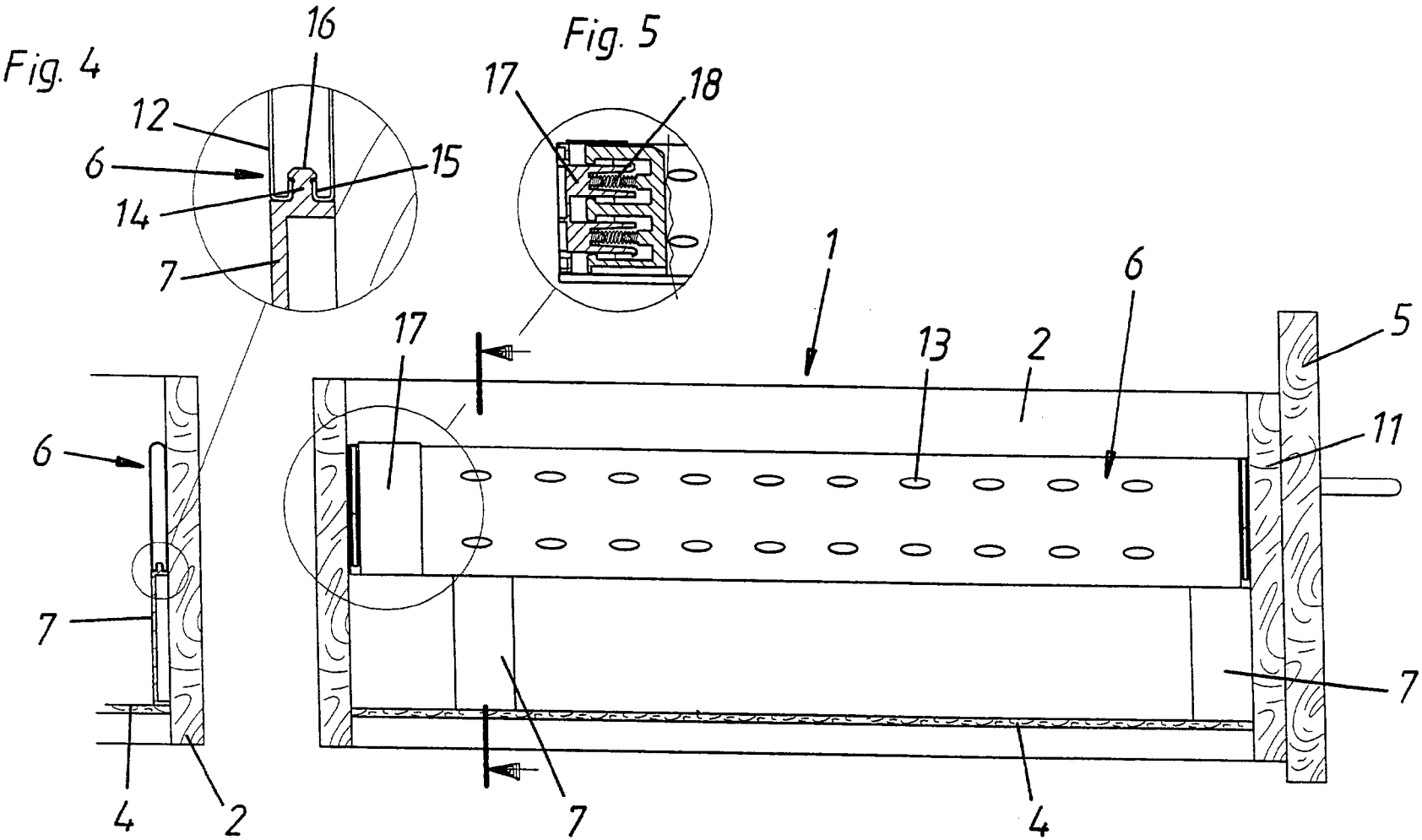
FIG. 4 is a vertical section through a drawer side wall and a rail according to the invention.
FIG. 5 is a longitudinal section through a drawer according to the invention.

The opening in the lower edged of the rail 6 is surrounded by collar-like edges 15, and the web-like projection 14 is provided with a head 16 that abuts against the edges 15. As a result of this, a stable push-in connection is produced. As can be seen from FIG. 3, further dividers 10 in the manner of a display cabinet can be placed on the partition walls 8, since the partition walls 8 are anchored in the drawer 1 with sufficient stability by means of the rails 6.

What is claimed is:

1. A drawer comprising:

a pair of side walls;

a rear wall;

a front wall;

a drawer base plate;

a pair of rails each being arranged on a respective one of the side walls, the rails extending from the rear wall to the front wall and having at least one of holes and depressions therein;

at least one transverse divider extending between the side walls and being connected to the rails via the at least one of the holes and the depressions; and a plurality of supporting struts, wherein each of the rails is supported against the drawer base plate by at least one of the supporting struts, wherein the side walls are free of holes or depressions, the rails each have at least one spring press-on part for pressing against one of the front wall and the rear wall by expansion and supporting that rail, and the rails laterally abut against the side walls without being anchored thereto.

2. A drawer as claimed in claim 1, wherein each of the rails is supported against the drawer base plate by two of the supporting struts.

3. A drawer as claimed in claim 1, wherein upper edges of the supporting struts have projections and lower edges of the rails have depressions adapted to receive the projections of the supporting struts.

4. A drawer as claimed in claim 3, wherein the projections are web shaped.

5. A drawer as claimed in claim 3, wherein the projections have heads that abut against edges of the rails that delimit the depressions.

6. A drawer as claimed in claim 1, wherein upper edges of the supporting struts have projections and lower edges of the rails have openings adapted to receive the projections of the supporting struts.

7. A drawer as claimed in claim 6, wherein the projections are web shaped.

8. A drawer as claimed in claim 6, wherein the projections have heads that abut against edges of the rails that delimit the openings.

* * * * *